US008959877B2

(12) United States Patent
Maki et al.

(10) Patent No.: US 8,959,877 B2
(45) Date of Patent: Feb. 24, 2015

(54) FOOD PACKAGING CARTON AND METHOD OF MAKING PACKAGING CARTON

(75) Inventors: James J. Maki, McHenry, IL (US); Marcus H. Parsons, Crystal Lake, IL (US); Glenn Ventrell, Barrington, IL (US)

(73) Assignee: The Quaker Oats Company, Chicago, IL (US)

( * ) Notice: Subject to any disclaimer, the term of this patent is extended or adjusted under 35 U.S.C. 154(b) by 502 days.

(21) Appl. No.: 13/479,970

(22) Filed: May 24, 2012

(65) Prior Publication Data

US 2013/0312369 A1 Nov. 28, 2013

(51) Int. Cl.

| | |
|---|---|
| ***B65B 61/18*** | (2006.01) |
| ***B65B 43/10*** | (2006.01) |
| ***B65D 5/54*** | (2006.01) |
| ***B31B 49/02*** | (2006.01) |
| ***B65D 5/66*** | (2006.01) |

(52) U.S. Cl.

CPC *B65D 5/542* (2013.01); *B65D 5/54* (2013.01); *B31B 49/02* (2013.01); *B65D 5/6608* (2013.01); *B65B 61/18* (2013.01); *B65B 43/10* (2013.01); *B65D 5/545* (2013.01)

USPC ..... 53/412; 53/456; 229/121; 229/232; 229/237; 229/242; 493/63

(58) Field of Classification Search

CPC ..... B65D 5/6608; B65D 5/54; B65D 5/542; B65D 5/445; B65D 5/545; B65B 61/18; B65B 61/184; B65B 43/39; B65B 43/10; B31B 49/02

USPC ..... 53/412, 456; 493/63; 229/121, 210, 229/232, 237, 240, 242, 243

See application file for complete search history.

(56) References Cited

U.S. PATENT DOCUMENTS

| | | | | |
|---|---|---|---|---|
| 3,355,089 A | | 11/1967 | Champlin | |
| 3,580,482 A | * | 5/1971 | Witte | 229/232 |
| 3,917,158 A | * | 11/1975 | Dorofachuk et al. | 229/240 |
| 4,043,503 A | * | 8/1977 | Meyers et al. | 229/232 |
| 4,158,412 A | * | 6/1979 | Wysocki | 229/242 |
| 4,836,383 A | | 6/1989 | Gordon et al. | |

(Continued)

FOREIGN PATENT DOCUMENTS

| | | | | |
|---|---|---|---|---|
| EP | 536103 A1 | * | 4/1993 | 229/240 |
| WO | 2009/014196 A1 | | 1/2009 | |

(Continued)

OTHER PUBLICATIONS

International Search Report dated Jan. 17, 2014 for PCT Application No. PCT/US2013/037451 (24 pages).

*Primary Examiner* — Stephen F Gerrity

(74) *Attorney, Agent, or Firm* — James R. Gourley; Colin P. Cahoon; Carstens & Cahoon, LLP

(57) ABSTRACT

A packaging carton for a food product is disclosed, where the carton includes a front face, a back face, two side faces, a top face and a bottom face, where these faces define an interior storage cavity, at least the back face of the packaging carton includes a perforation defining an opening flap and the opening flap may be permanently removed by separating the opening flap from a face or faces of the carton along the perforation to define an access opening that allows access to the interior storage cavity. A method of making a packaging carton for a food product is also disclosed.

16 Claims, 10 Drawing Sheets

(56) References Cited

U.S. PATENT DOCUMENTS

| | | | |
|---|---|---|---|
| 5,482,203 | A | 1/1996 | Stout |
| D412,114 | S | 7/1999 | Hansen |
| D413,802 | S | 9/1999 | Glover et al. |
| 6,138,905 | A | 10/2000 | Hachenski |
| D436,859 | S | 1/2001 | Botsford et al. |
| 6,435,351 | B1 | 8/2002 | Gibb |
| D506,927 | S | 7/2005 | Sharron |
| 6,968,992 | B2 | 11/2005 | Schuster |
| 7,000,824 | B2 | 2/2006 | Saulas |
| 7,004,897 | B2 | 2/2006 | Spivey, Sr. |
| 7,007,836 | B2 | 3/2006 | Smalley |
| 7,021,468 | B2 | 4/2006 | Cargile, Jr. |
| 7,175,047 | B2 | 2/2007 | Spivey |
| 7,225,930 | B2 | 6/2007 | Ford et al. |
| 7,237,674 | B2 | 7/2007 | Auclair |
| D569,719 | S | 5/2008 | Ross |
| 7,533,773 | B2 | 5/2009 | Aldridge et al. |
| D601,419 | S | 10/2009 | Sant' Ana Caceres et al. |
| 7,621,438 | B2 | 11/2009 | Spivey, Sr. |
| 7,648,060 | B2 | 1/2010 | DeBusk |
| 7,810,641 | B2 | 10/2010 | Hungler et al. |
| 7,832,622 | B2 | 11/2010 | Spivey, Sr. |
| D629,296 | S | 12/2010 | De Muynck |
| 7,870,994 | B2 | 1/2011 | Spivey, Sr. et al. |
| 7,966,789 | B2 | 6/2011 | Hand et al. |
| 8,063,345 | B2 | 11/2011 | Middleton et al. |
| 8,118,212 | B2 | 2/2012 | Miller |
| 2005/0109827 | A1* | 5/2005 | Martin ..... 229/232 |
| 2006/0266815 | A1 | 11/2006 | Coltri-Johnson et al. |
| 2007/0102497 | A1 | 5/2007 | Borek et al. |
| 2011/0259916 | A1 | 10/2011 | Spivey, Sr. et al. |

FOREIGN PATENT DOCUMENTS

| | | | |
|---|---|---|---|
| WO | 2009/049308 | A1 | 4/2009 |
| WO | 2009154092 | | 12/2009 |
| WO | 20100014438 | | 2/2010 |
| WO | 2011157572 | | 12/2011 |

* cited by examiner

FOOD PACKAGING CARTON AND METHOD OF MAKING PACKAGING CARTON

FIELD OF THE INVENTION

This invention relates to packaging cartons for food products. In particular, this invention relates to an improved packaging carton and the method of making such a carton.

BACKGROUND

Packaging for individually wrapped food products often consists of a carton that may be opened and closed to allow consumers access to the products inside. The carton is generally made of an opaque material that does not provide visual access to the contents of the container. This can inconvenience consumers by not allowing them to quickly assess the number of remaining food products and can also lower the probability of consumption of the food products. Moreover, typical cartons require the consumer to reopen and close the carton every time a food product is desired, causing further inconvenience and preventing easy access to the contents.

To alleviate these inefficiencies, it may be desirable to utilize an improved packaging carton that provides convenience to the consumer by allowing visual access to the food products contained therein. It may also be desirable to utilize a packaging carton that provides consumers with two options for easily opening the carton. It may be still more desirable to utilize a container with these characteristics that still efficiently uses space by providing upright storage.

It is an object of the invention to provide packaging cartons that, amongst other features and advantages, address these objectives. It is an object of certain embodiments of the invention to provide a packaging carton for food products. It is an object of other embodiments of the invention to provide a method for making a packaging carton for food products. These and other objects, features and advantages of the invention or of certain embodiments of the invention will be apparent to those skilled in the art from the following disclosure and description of exemplary embodiments.

SUMMARY

In accordance with one aspect of the invention a packaging carton for a food product is provided that includes a front face, a back face, a first side face connecting a first side edge of the front face and a first side edge of the back face, a second side face connecting a second side edge of the front face and a second side edge of the back face, a top face connecting a top edge of the front face, back face, first side face and second side face, a bottom face connecting a bottom edge of the front face, back face, first side face and second side face, wherein the front, back, first side, second side, top and bottom faces define an interior storage cavity, wherein at least the back face of the packaging carton comprises a perforation defining an opening flap, and wherein the opening flap may be permanently removed by separating the opening flap from at least the back face along the perforation to define an access opening in at least the back face that allows access to the interior storage cavity.

In certain exemplary embodiments, the opening flap comprises a tab including at least one folding edge and at least one perforation edge, wherein the at least one perforation edge forms at least a portion of the perforation defining the opening flap, and wherein the at least one folding edge disposes the tab to be folded into the interior storage cavity when the tab and at least the back face are separated along the at least one perforation edge. In still other exemplary embodiments, the opening flap's shape is parabolic.

In other exemplary embodiments, the top face, back face, and top edge of the front face comprise the perforation defining the opening flap, and the opening flap may be permanently removed by separating the opening flap from the top face and back face along the perforation to define an access opening in the top face and back face that allows access to the interior storage cavity.

In still other exemplary embodiments, the first side face is an access face comprising a first side front flap attached to the first side edge of the front face, a first side back flap attached to the first side edge of the back face, wherein the first side front flap and first side back flap comprise a fastener assembly, and wherein the fastener assembly selectively allows the first side front flap and first side back flap to engage each other to form the first side face or disengage each other to allow access to the interior cavity.

In certain other exemplary embodiments, the front face is a single panel, the back face is a single panel, the top face is a single panel, the bottom face is a single panel, the first side face is an access face comprising a first side front flap attached to the first side edge of the front face, a first side back flap attached to the first side edge of the back face, a first side top flap connected to a first side edge of the top face, a first side bottom flap connected to a first side edge of the bottom face, and a fastener assembly, wherein the fastener assembly selectively allows the first side front flap and first side back flap to securely engage each other or disengage each other to allow access to the interior cavity. In these embodiments the second side face comprises a second side front flap attached to the second side edge of the front face, a second side back flap attached to the second side edge of the back face, a second top side flap connected to a second side edge of the top face, a second bottom side flap connected to a second side edge of the bottom face, wherein the second side face flaps are attached together by an adhesive, and a back bottom flap attached to the back edge of the bottom face is attached to the back face by an adhesive.

In yet other exemplary embodiments, the front face is a single panel, the back face is a single panel, the first side face comprises a first side front flap attached to the first side edge of the front face, a first side back flap attached to the first side edge of the back face, and a fastener assembly, wherein the fastener assembly selectively allows the first side front flap and first side back flap to securely engage each other or disengage each other. Further, in these embodiments the second side face is a single panel, the top face comprises a top back flap attached to a top edge of the back face, a top front flap attached to a top edge of the front face, a top first side flap attached to a top edge of the first side face, a top second side flap attached to a top edge of the second side face, and the bottom face comprises a bottom back flap attached to a bottom edge of the back face, a bottom front flap attached to a bottom edge of the front face, a bottom first side flap attached to a bottom edge of the first side face, a bottom second side flap attached to a bottom edge of the second side face. In these exemplary embodiments, the front face is foldably connected to a front edge of the second side face such that the front face can rotate about an axis defined by the front edge of the second face when the fastener assembly is not engaged, allowing access to the interior cavity, and the perforation defines an opening flap with an area covering at least a portion of the back face. In some exemplary embodiments, the perforation defines an opening flap with an area covering at least a portion of the back face and the entire top face.

In accordance with another aspect of the invention, a method making a packaging carton for a food product is disclosed that includes providing a blank, assembling the blank into a container with a front face, a back face, a first side face connecting a first side edge of the front face and a first side edge of the back face, a second side face connecting a second side edge of the front face and a second side edge of the back face, a top face connected to a top edge of the front face, back face, first side face and second side face, and a bottom face connected to a bottom edge of the front face, back face, first side face and second side face, wherein the front, back, first side, second side, top and bottom faces define an interior storage cavity, and defining an opening flap on at least the back face by perforating the material of at least the back face so that the opening flap may be permanently removed by separating the opening flap from at least the back face along the perforation to define an access opening in at least the back face that allows access to the interior storage cavity.

In certain exemplary embodiments, the method further comprises defining a tab comprising with least one folding edge and at least one perforation edge, wherein the at least one perforation edge forms at least a portion of the perforation defining the opening flap and wherein the at least one folding edge disposes the tab to be folded into the interior storage cavity when the tab and at least the back face are separated along the at least one perforation edge.

In yet other exemplary embodiments, the perforation is made by laser or blade scoring. In still other embodiments, the opening flap's shape is parabolic. In certain other embodiments, the method further comprises defining the opening flap such that the perforation covers some or all of the top face, back face, and top edge of the front face, such that the opening flap may be permanently removed by separating the opening flap from the top face and back face along the perforation to define an access opening in the top face and back face that allows access to the interior storage cavity.

In some other exemplary embodiments, the first side face is an access face comprising a first side front flap attached to the first side edge of the front face, a first side back flap attached to the first side edge of the back face, wherein the first side front flap and first side back flap comprise a fastener assembly, and wherein the fastener assembly selectively allows the first side front flap and first side back flap to engage each other to form the first side face or disengage each other to allow access to the interior cavity.

In still other exemplary embodiments of the method, the front face is a single panel, the back face is a single panel, the top face is a single panel, the bottom face is a single panel, and the first side face is an access face comprising a first side front flap attached to the first side edge of the front face, a first side back flap attached to the first side edge of the back face, a first top side flap connected to a first side edge of the top face, a first bottom side flap connected to a first side edge of the bottom face, and a fastener assembly, wherein the fastener assembly selectively allows the first side front flap and first side back flap to securely engage each other or disengage each other to allow access to the interior cavity. In these embodiments, the second side face comprises a second side front flap attached to the second side edge of the front face, a second side back flap attached to the second side edge of the back face, a second top side flap connected to a second side edge of the top face, a second bottom side flap connected to a second side edge of the bottom face and the bottom face comprises a bottom flap. In these embodiments, the method further comprises folding the blank along the top and bottom edges of the front face and back face to define the interior cavity, attaching the second side face flaps together by an adhesive and attaching the back bottom flap attached to the back edge of the bottom face to the back face by an adhesive. In some of these embodiments, the method further comprises loading at least one food product into the interior cavity and fastening the fastener assembly of the first side face.

In certain other exemplary embodiments of the method, the front face is a single panel, the back face is a single panel, the first side face comprises a first side front flap attached to the first side edge of the front face, a first side back flap attached to the first side edge of the back face, and a fastener assembly, wherein the fastener assembly selectively allows the first side front flap and first side back flap to securely engage each other or disengage each other. In these embodiments, the second side face is a single panel, the perforation defines an opening flap with an area covering at least a portion of the back face, and the front face is foldably connected to a front edge of the second side face such that the front face can rotate about an axis defined by the front edge of the second face when the fastener assembly is not engaged to allow access to the interior cavity. In these embodiments, the method further comprises folding the blank along the first side edge of the back face, second side edge of the back face, and second side edge of the front face to define the interior cavity, connecting a top back flap attached to a top edge of the back face, a top first side flap attached to a top edge of the first side, and a top second side flap attached to a top edge of the second side to comprise the top face; a connecting a bottom back flap attached to a bottom edge of the back face, a bottom first side flap attached to a bottom edge of the first side and a bottom second side flap attached to a bottom edge of the second side to comprise the bottom face. In certain of these embodiments, the method further comprises loading at least one food product into the interior cavity, folding the front face about the axis defined by the front edge of the second face to enclose the interior cavity and fastening the fastener assembly of the first side face.

In still other exemplary embodiments of the method, the packaging container is shaped and sized to provide an upright storage container. In yet other examples the blank is assembled on a high speed cartoning line. In certain of these exemplary embodiments, the method further comprises loading at least one food item into the packaging carton on the high speed cartoning line.

BRIEF DESCRIPTION OF THE DRAWINGS

Exemplary embodiments of the disclosure will now be described by way of example only and with reference to the accompanying drawings, in which.

DETAILED DESCRIPTION OF EMBODIMENTS

The embodiments, apparatuses and methods described herein provide a packaging carton for at least one food product and a method of making such a packaging carton. These and other aspects, features and advantages of the invention or of certain embodiments of the invention will be further understood by those skilled in the art from the following description of exemplary embodiments.

Figure 1:
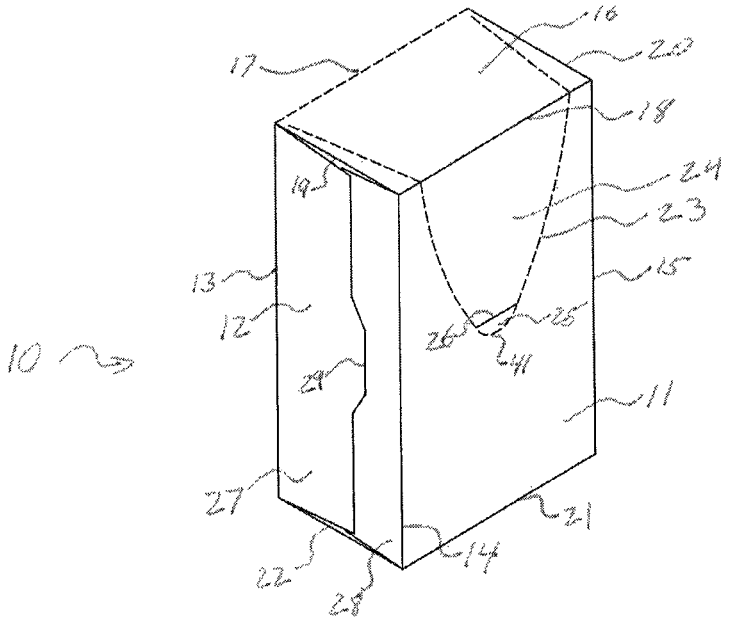
FIG. 1 shows a perspective view of a food packaging carton in accordance with at least one embodiment of the invention.

FIG. 1 shows an exemplary embodiment of the food packaging carton. In this embodiment, there is a food packaging carton 10 that includes a front face, a back face 11, a first side face 12 connecting a first side edge of the front face 13 and a first side edge of the back face 14, a second side face connecting a second side edge of the front face and a second side edge of the back face 15, a top face 16 connecting a top edge of the front face 17, a top edge of the back face 18, a top edge of the first side face 19 and a top edge of the second side face 20, a bottom face connecting a bottom edge of the front face, a bottom edge of the back face 21, a bottom edge of the first side face 22 and a bottom edge of the second side face. In this exemplary embodiment the front, back, first side, second side, top and bottom faces define an interior storage cavity. In this exemplary embodiment, the back and top faces of the packaging carton comprise a perforation 23 defining an opening flap 24. In certain embodiments perforation is only present on the back face, while in others it is on multiple faces, while in still others it is present on one or more of the edges connecting two faces of the carton. The perforation may be a wide variety of shapes including, but not limited to, triangular, rectangular, polygonal or parabolic. In the exemplary embodiment of FIG. 1, the perforation is parabolic in shape.

The perforation may take any number of forms as is known in the art. In some embodiments, the perforation is made by perforation wheel, rotary blade or laser scoring. In the exemplary embodiment of FIG. 1 the opening flap 24 of the carton 10 may be permanently removed by separating the opening flap 24 and the back face 11 and top face 16 along the perforation 23 to define an access opening that allows access to the interior storage cavity. In some embodiments the uncut linking portions of the carton material are uniform across the entire perforation. In others, the uncut linking portions are smaller in length, less frequent, or both in the bottom area of the opening flap to assist the user in beginning the removal process for the opening flap. In some embodiments, the perforation will extend partially through the thickness of the carton material, while in others or extend through the entire thickness of the carton material, while in others it will vary at different parts of the perforation.

In some embodiments, the food packaging carton is made of paperboard, fiberboard, cardboard or card stock. In some of these embodiments the material is corrugated. In certain embodiments the material is laminated, glossed, coated in wax, or treated with wet strength resins including, but not limited to, urea-formaldehyde, melamine-formaldehyde and polyamide-epichlorohydrin. In certain exemplary embodiments, some or all of the faces display graphics or information, including product or consumer information. The material of the food packaging carton has sufficient strength and rigidity to allow the carton to stand up to the rigors of distribution and/or warehousing.

The carton may be sized and shaped in many ways. In certain embodiments, the carton is rectangular, while in others it is square or polygonal. In some embodiments the relative dimensions of the cartons height, width and length are such that the upright storage capability of the carton is increased or maximized. In certain of these embodiments, the height of the carton is larger than the width or length to limit the area taken up by the bottom face while still allowing a large volume for the interior cavity. FIG. 1 shows an exemplary embodiment of this type of carton. These embodiments of the carton benefit the consumer by utilizing shelf or pantry space efficiently while allowing relatively large amounts of storage. The carton may be sized and shape to hold a wide variety of food products, including dry or wet cereal packages, cereal bars, power bars or snack bars. The food products may be arranged or loaded in any orientation desired.

In the exemplary embodiment of FIG. 1, the opening flap 24 comprises a tab 25 including at least one folding edge 26 and at least one perforation edge 41. In this embodiment the perforation edge forms a portion of the perforation 23 defining the opening flap 24 and the folding edge 26 disposes the tab 25 to be folded into the interior storage cavity. When a consumer desires they may push in on the tab 25 to separate the lower portions of perforation 23 and insert a finger into the interior cavity of the carton. The consumer may then easily pull upwards to separate the opening flap 24 along the remaining sections of the perforation 23 to remove the opening flap and create an access opening. The access opening may take any shape as defined by the perforation and can allow access through one or more faces of the carton. In some embodiments, the perforation is made of completely by straight lines, while in others it is partially or entirely curved. Any number of lines or curves joined together can form the perforation. In some embodiments, some or all of the perforation may run along one or more edges of the carton. In some embodiments, the perforation allows access through an access opening through portions of one or more faces once the opening flap is removed. In other embodiments, the access opening allows access through the entire area of a face. This provides consumers quick and easy access a food product contained inside the interior cavity.

Figure 2:
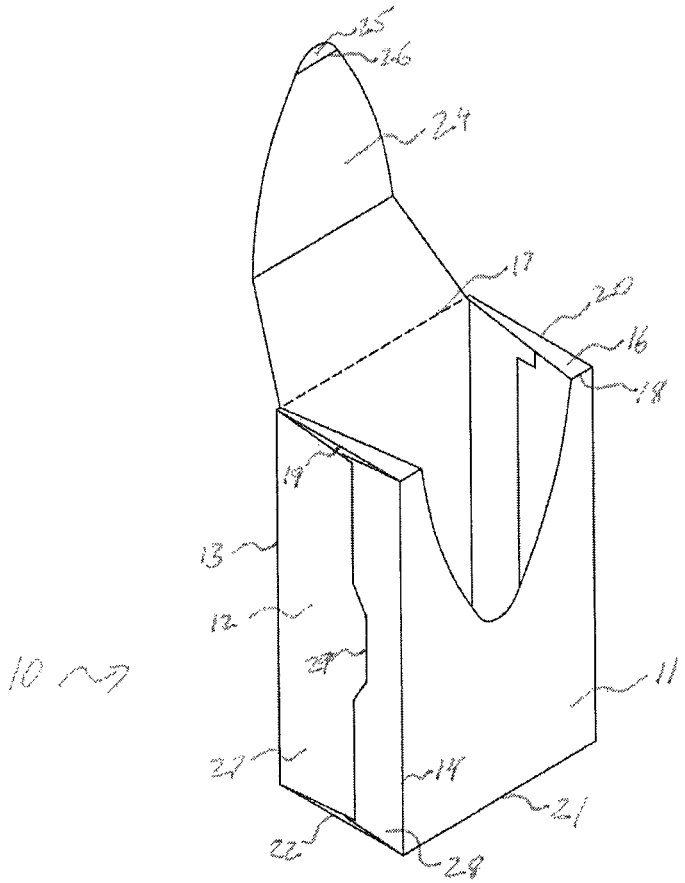
FIG. 2 shows the same food packaging carton from FIG. 1 with the opening flap partially removed.
Figure 3:
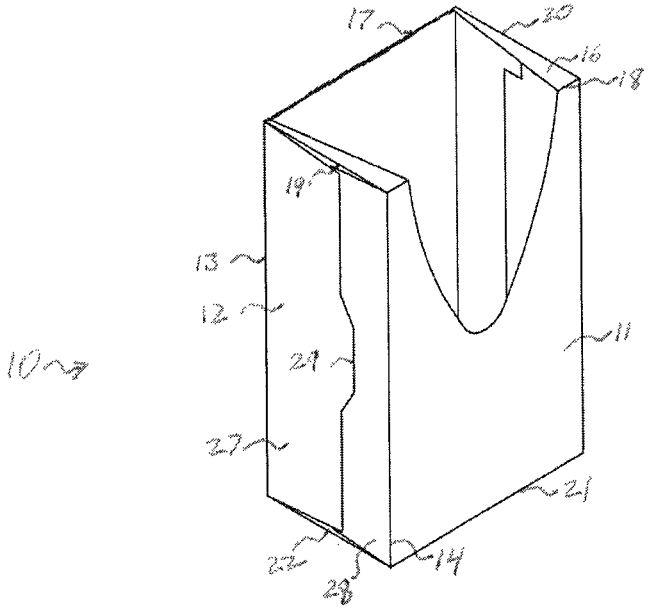
FIG. 3 shows the same food packaging carton from FIG. 1 with the opening flap entirely removed.

FIG. 2 shows the same exemplary embodiment from FIG. 1 with the opening flap 24 partially removed to provide an access opening to the interior cavity. In certain embodiments, the access opening is sized and shaped to allow the consumer convenient access to a food product or products contained inside, yet still provides strength and stability for the carton as a whole. FIG. 2 shows an embodiment where portions of the top face remain even after the opening flap 24 is separated, allowing significant visual access to the interior cavity while still providing structural support for the carton's overall shape. FIG. 3 shows the same exemplary embodiment from FIGS. 1 and 2 with the opening flap completely removed.

In the exemplary embodiment from FIGS. 1-3, the first side face 12 is an access face with a first side front flap 27 is attached to the first side edge of the front face 13, a first side back flap 28 attached to the first side edge of the back face 14. In this exemplary embodiment the first side front flap 27 and first side back flap 28 comprise a fastener assembly 29, where the fastener assembly selectively allows the first side front flap and first side back flap to engage each other to form the first side face 12 or disengage each other to allow access to the interior cavity. In this and other embodiments where the first side face 12 is an access face consumers have an additional and more traditional option for accessing the interior cavity and the food products contained therein, even when the opening flap 24 is not removed. This provides additional convenience to consumers and accounts for varying preferences or storage capabilities among consumers. In this exemplary embodiment, the fastener assembly 29 is a tab and corresponding cut and flap allowing insertion of the tab under the primary surface of a first side back flap. Other appropriate fastener assemblies including, but not limited to, locking tabs may be used. In some exemplary embodiments the first side front flap 27 and first side back flap 28 are initially attached by an adhesive and the fastener assembly 29 is not engaged, where the consumer can utilize the fastener assembly 29 after opening the first side front flap 27 and first side back flap 28 to access the interior cavity.

Figure 4:
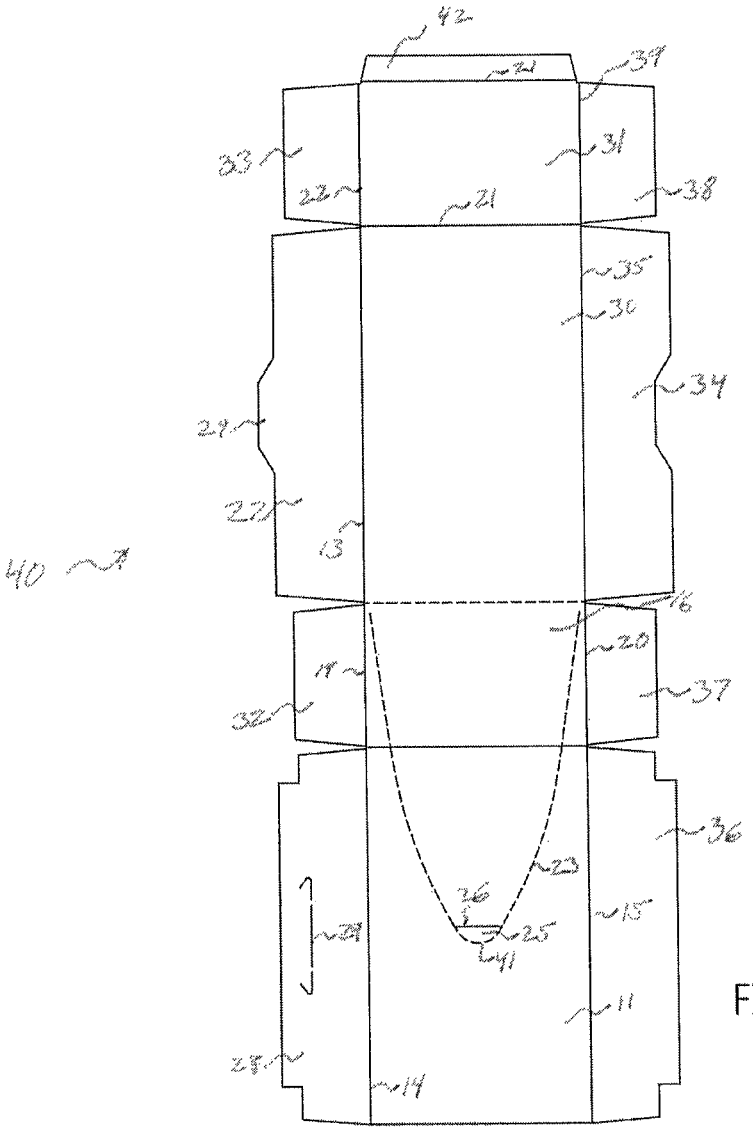
FIG. 4 shows a top view of a food packaging carton blank in accordance with at least one embodiment of the invention.

FIG. 4 shows a top view of an exemplary embodiment of a food packaging carton blank before assembly. This exemplary embodiment, when assembled, will provide the food packaging carton embodiment displayed in FIGS. 1-3. In this embodiment, the front face 30 is a single panel, the back face 11 is a single panel, the top face 16 is a single panel and the bottom face 31 is a single panel. In this exemplary embodiment, the first side face is an access face formed by a first side front flap 27 attached to the first side edge of the front face 13, a first side back flap 28 attached to the first side edge of the back face 14, a first side top flap 32 connected to a first side edge of the top face 19, a first side bottom flap 33 connected to a first side edge of the bottom face 22, and a fastener assembly 29, where the fastener assembly 29 selectively allows the first side front flap 27 and first side back flap 28 to securely engage each other or disengage each other to allow access to the interior cavity.

In this exemplary embodiment the second side face is formed by a second side front flap 34 attached to the second side edge of the front face 35, a second side back flap 36 attached to the second side edge of the back face 15, a second side top flap 37 connected to the second side edge of the top face 20, and a second side bottom flap 38 connected to a second side edge of the bottom face 39. In this exemplary embodiment, at least the second side face flaps are attached together by an adhesive when the blank is assembled, and a back bottom flap 42 that is connected to the back edge of the bottom face is attached to the back face by an adhesive when the blank is assembled. The size and dimensions of these panels and flaps can vary greatly across different embodiments of the invention. In some embodiments, at least some of the flaps are designed to be full overlap flaps to provide maximum strength and structural stability to the packaging carton. In certain embodiments, the face panels and/or flaps of the blank are foldably connected by score lines. In other embodiments the blank is creased to separate the panels and/or flaps. In some embodiments, one or more of the flaps are connected with locking tabs, a fastener assembly, a tab and corresponding slit, an adhesive, tape, staple or a combination thereof.

Figure 5:
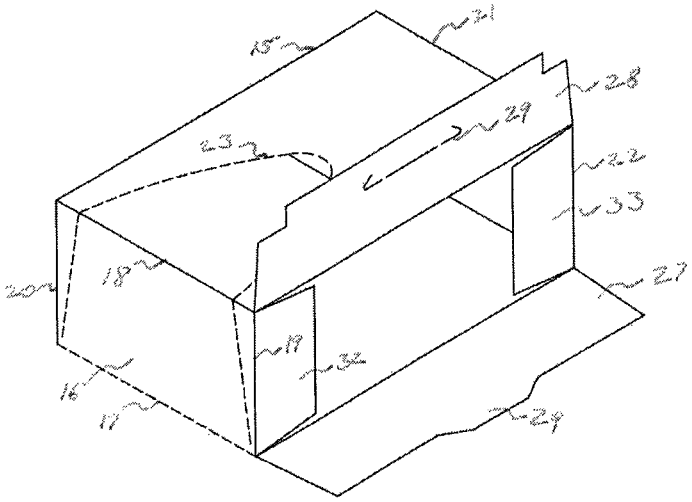
FIG. 5 shows a perspective view of the same food packaging carton blank from FIG. 4 when assembled into a packaging carton.

FIG. 5 shows the same exemplary embodiment in the partially assembled form. The fastener assembly 29 of the first side face 12 is not engaged, allowing access to the interior cavity. In this form, the packaging carton may be loaded with at least one food item while resting on any of its faces, except the first side face 12, before the fastener assembly 29 is engaged to close the first side face 12 once the food items are placed inside the interior cavity. This allows the food packaging carton to be assembled and loaded very quickly. In certain of these embodiments, the carton is assembled and loaded on a high speed cartoning line or with other high speed cartoning equipment.

Figure 6:
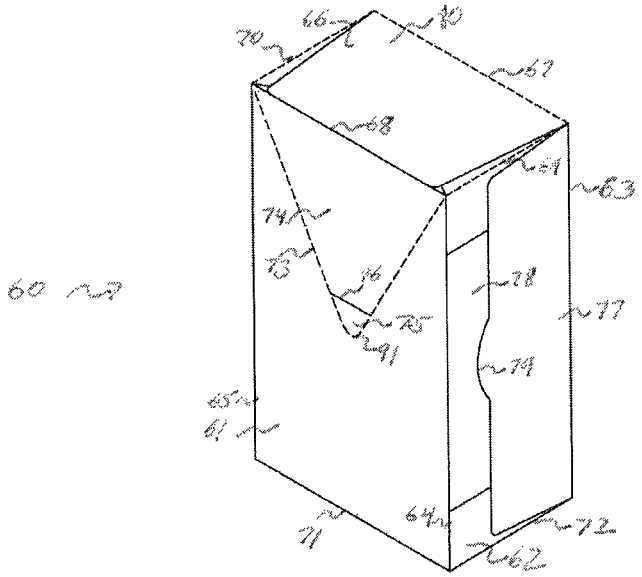
FIG. 6 shows a perspective view of another food packaging carton in accordance with at least one embodiment of the invention.

FIG. 6 provides another exemplary embodiment of the food packaging container. In this exemplary embodiment, the front face is a single panel, the back face 61 is a single panel and the second side face is a single panel. The first side face 62 is an access face and is made from a first side front flap 77 attached to the first side edge of the front face 63, a first side back flap 78 attached to the first side edge of the back face 64, and a fastener assembly 79 that selectively allows the first side front flap 77 and first side back flap 78 to securely engage each other or disengage each other. In this exemplary embodiment, the top face 66 is made from a top back flap attached to a top edge of the back face 68, a top front flap 80 attached to a top edge of the front face 67, a top first side flap attached to a top edge of the first side 69, a top second side flap attached to a top edge of the second side 70.

In this exemplary embodiment, the bottom face is made from a bottom back flap attached to a bottom edge of the back face 71, a bottom front flap attached to a bottom edge of the front face, a bottom first side flap attached to a bottom edge of the first side 72, a bottom second side flap attached to a bottom edge of the second side. In this exemplary embodiment, the perforation 73 defines an opening flap 74 with an area covering at a portion of the back face 61 and the entire top face 66. In this embodiment, the opening flap 74 has a folding edge 76 and perforation edge 91. In this exemplary embodiment, the front face is foldably connected to a front edge of the second side face such that the front face can rotate about an axis defined by the front edge of the second face when the fastener assembly 79 is not engaged to allow access to the interior cavity.

Figure 7:
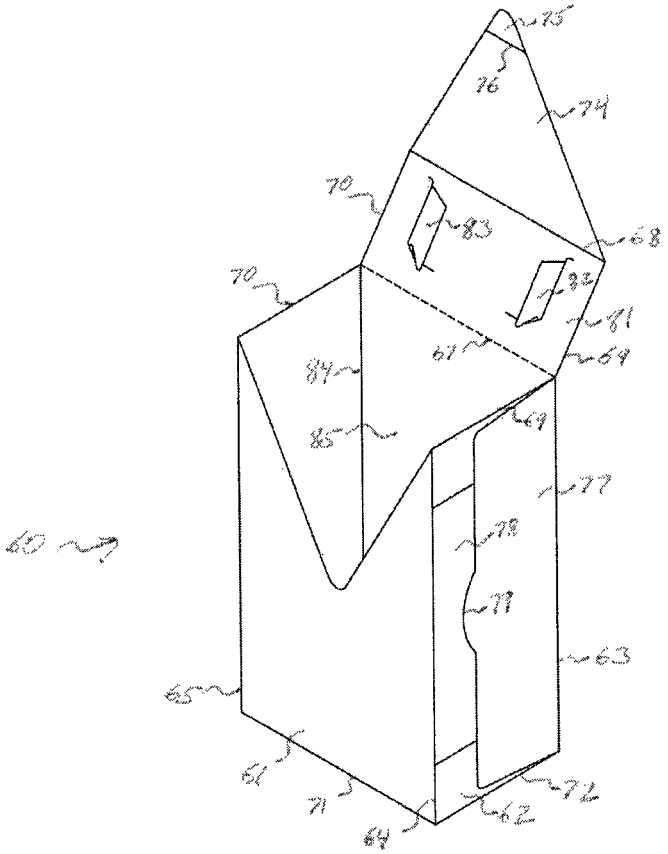
FIG. 7 shows the same food packaging carton from FIG. 6 with the opening flap partially removed.
Figure 8:
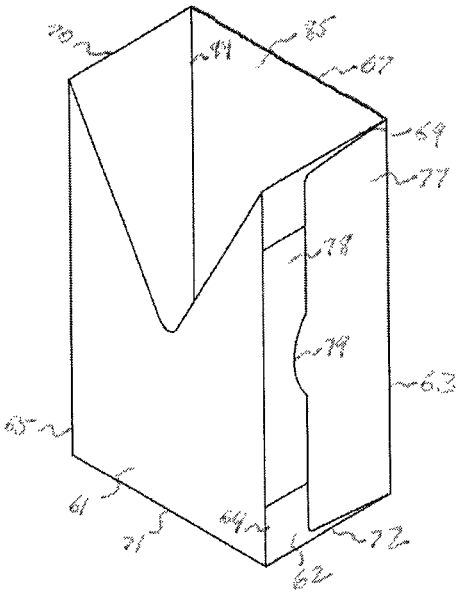
FIG. 8 shows the same food packaging carton from FIG. 6 with the opening flap entirely removed.

FIGS. 7 and 8 show the same exemplary embodiment from FIG. 6 with the opening flap 74 partially or entirely removed. FIG. 7 provides another view of the top face 66. In this exemplary embodiment, a top back flap 81 attached to a top edge of the back face 68, a top front flap attached to a top edge of the front face 67, a top first side flap 82 attached to a top edge of the first side 69, a top second side flap 83 attached to a top edge of the second side 70 combine to form the top face 66. In this embodiment, the top side flaps enter into a corresponding slit in the top back flap 81 and are retained therein. In other embodiments, some or all of the top face flaps are attached by adhesion, flaps and corresponding slits, locking tabs, staples, tape, or a combination thereof. FIG. 8 shows the exemplary embodiment with the opening flap 74 entirely removed. The access cavity created covers a portion of the back face 61 and all of the top face 66 as the perforation 73 ran along a portion of the back face 61, the first side top edge 69, the front top edge 67 and the second side top edge 70. In FIGS. 7 and 8, the second side front edge 84 that forms the rotatable axis for the front face 85 is visible.

Figure 9:
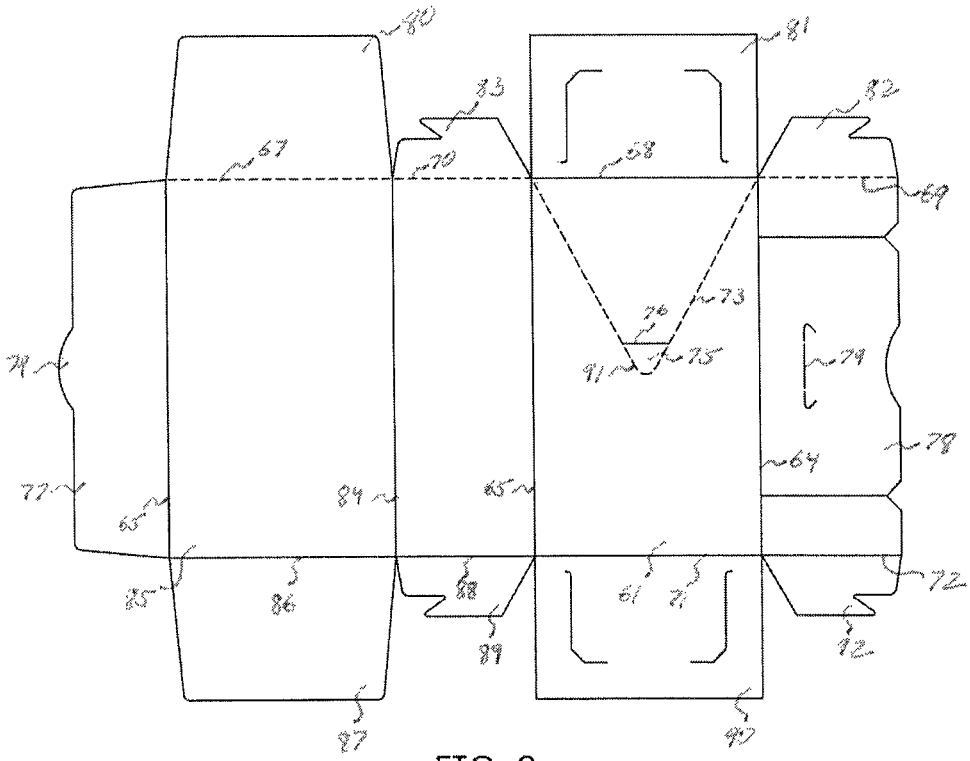
FIG. 9 shows a top view of a food packaging carton blank in accordance with at least one embodiment of the invention.

FIG. 9 provides a view of the unassembled blank forming the exemplary food packaging carton from FIGS. 6-8. In certain embodiments, the face panels and/or flaps of the blank are foldably connected by score lines. In other embodiments the blank is creased to separate the panels and/or flaps. In this view of the unassembled blank, a bottom back flap 90 attached to a bottom edge of the back face 71, a bottom front flap 87 attached to a bottom edge of the front face 86, a bottom first side flap 92 attached to a bottom edge of the first side 72 and a bottom second side flap 89 attached to a bottom edge of the second side 88 are visible.

Figure 10:
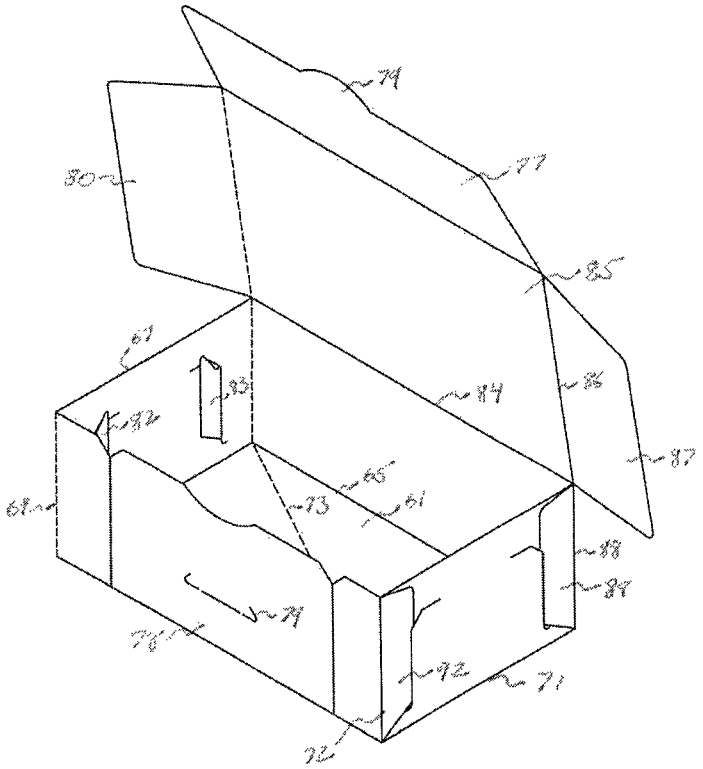
FIG. 10 shows a perspective view of the same food packaging carton blank from FIG. 9 when assembled into a packaging carton.

FIG. 10 shows the same exemplary embodiment in the partially assembled form. The fastener assembly 79 of the first side face 62 is not engaged and the front face 85 is rotated away from the interior cavity along the axis defined by the second side front edge 84. This form of the partially assembled carton allows access to the interior cavity and the packaging carton may be loaded with at least one food before the fastener assembly is engaged to close the first side face. This allows the food packaging carton to be assembled and loaded very quickly. In certain of these embodiments, the carton is assembled and loaded on a high speed cartoning line or with other high speed cartoning equipment.

These descriptions of the packaging carton are merely exemplary. In certain embodiments, the packaging carton comprises additional combinations or substitutions of some or all of the components described above. Moreover, additional and alternative suitable variations, forms and components for the packaging carton will be recognized by those skilled in the art given the benefit of this disclosure.

Other aspects of the invention relate to a method for making a packaging container for at least one food product. Any step of the method may include one or more aspects of the food packaging cartons described above, or any additional and alternative suitable variations, forms and components for the packaging carton.

In this aspect of the invention, the method includes providing a blank, assembling the blank into a container with a front face, a back face, a first side face connecting a first side edge of the front face and a first side edge of the back face, a second side face connecting a second side edge of the front face and a second side edge of the back face, a top face connected to a top edge of the front face, back face, first side face and second side face, and a bottom face connected to a bottom edge of the front face, back face, first side face and second side face, wherein the front, back, first side, second side, top and bottom faces define an interior storage cavity, and defining an opening flap on at least the back face by perforating the material of at least the back face so that the opening flap may be permanently removed by separating the opening flap and at least the back face along the perforation to define an access opening in at least the back face that allows access to the interior storage cavity.

In certain exemplary embodiments, the method further includes defining a tab comprising at least one folding edge and at least one perforation edge, wherein the at least one perforation edge forms at least a portion of the perforation defining the opening flap and wherein the at least one folding edge disposes the tab to be folded into the interior storage cavity when the tab and at least the back face are separated along the at least one perforation edge.

In yet other exemplary embodiments, the perforation is made by laser or blade scoring. In certain other embodiments, the method further comprises defining the opening flap such that the perforation covers some or all of the top face, back face, and top edge of the front face, such that the opening flap may be permanently removed by separating the opening flap from the top face and back face along the perforation to define an access opening in the top face and back face that allows access to the interior storage cavity. In still other embodiments, the opening flap's shape is parabolic.

In some other exemplary embodiments, the first side face is an access face comprising a first side front flap attached to the first side edge of the front face, a first side back flap attached to the first side edge of the back face, wherein the first side front flap and first side back flap comprise a fastener assembly, and wherein the fastener assembly selectively allows the first side front flap and first side back flap to engage each other to form the first side face or disengage each other to allow access to the interior cavity.

In still other exemplary embodiments of the method, the front face is a single panel, the back face is a single panel, the top face is a single panel, the bottom face is a single panel, and the first side face is an access face comprising a first side front flap attached to the first side edge of the front face, a first side back flap attached to the first side edge of the back face, a first top side flap connected to a first side edge of the top face, a first bottom side flap connected to a first side edge of the bottom face, and a fastener assembly, wherein the fastener assembly selectively allows the first side front flap and first side back flap to securely engage each other or disengage each other to allow access to the interior cavity.

In these embodiments, the second side face comprises a second side front flap attached to the second side edge of the front face, a second side back flap attached to the second side edge of the back face, a second top side flap connected to a second side edge of the top face, a second bottom side flap connected to a second side edge of the bottom face and the bottom face comprises a bottom flap. In these embodiments, the method further comprises folding the blank along the top and bottom edges of the front face and back face to define the interior cavity, attaching the second side face flaps together by an adhesive and attaching the back bottom flap to the back face by an adhesive. In some of these embodiments, the method further comprises loading at least one food product into the interior cavity and fastening the fastener assembly of the first side face.

In certain other exemplary embodiments of the method, the front face is a single panel, the back face is a single panel, the first side face comprises a first side front flap attached to the first side edge of the front face, a first side back flap attached to the first side edge of the back face, and a fastener assembly, wherein the fastener assembly selectively allows the first side front flap and first side back flap to securely engage each other or disengage each other. In these embodiments, the second side face is a single panel, the perforation defines an opening flap with an area covering at least a portion of the back face. In certain of these embodiments, and the perforation defines an opening flap with an area covering at least a portion of the back face the entire top face. In some embodiments, the front face is foldably connected to a front edge of the second side face such that the front face can rotate about an axis defined by the front edge of the second face when the fastener assembly is not engaged to allow access to the interior cavity.

In these embodiments, the method further comprises folding the blank along the first side edge of the back face, second side edge of the back face, and second side edge of the front face to define the interior cavity, connecting a top back flap attached to a top edge of the back face, a top first side flap attached to a top edge of the first side, and a top second side flap attached to a top edge of the second side to comprise the top face, connecting a bottom back flap attached to a bottom edge of the back face, a bottom first side flap attached to a bottom edge of the first side and a bottom second side flap attached to a bottom edge of the second side to comprise the bottom face. In certain of these embodiments, the method further comprises loading at least one food product into the interior cavity, folding the front face about the axis defined by the front edge of the second face to enclose the interior cavity and fastening the fastener assembly of the first side face.

In still other exemplary embodiments of the method, the packaging container is shaped and sized to provide an upright storage container. In yet examples the blank is assembled on a high speed cartoning line. In certain of these exemplary embodiments, the method further comprises loading at least one food item into the packaging carton on the high speed cartoning line.

These method descriptions are merely exemplary. In certain embodiments, the method may include additional combinations or substitutions of some or all of the steps described above. Moreover, additional and alternative suitable variations, forms and components for the method will be recognized by those skilled in the art given the benefit of this disclosure.

What is claimed is:

1. A packaging carton for a food product comprising:

a front face, wherein the front face is a single panel;

a back face, wherein the back face is a single panel;

a first side face connecting a first side edge of the front face and a first side edge of the back face;

a second side face connecting a second side edge of the front face and a second side edge of the back face, wherein the second side face is a single panel;

a top face connecting a top edge of the front face, back face, first side face and second side face;

a bottom face connecting a bottom edge of the front face, back face, first side face and second side face;

wherein the front, back, first side, second side, top and bottom faces define an interior storage cavity;

wherein at least the back face of the packaging carton comprises a perforation defining an opening flap; and wherein the opening flap may be permanently removed by separating the opening flap and at least the back face along the perforation to define an access opening in at least the back face that allows access to the interior storage cavity;

wherein the first side face comprises a first side front flap attached to the first side edge of the front face, a first side back flap attached to the first side edge of the back face, and a fastener assembly, wherein the fastener assembly selectively allows the first side front flap and first side back flap to securely engage each other or disengage each other;

wherein the top face comprises a top back flap attached to a top edge of the back face, a top front flap attached to a top edge of the front face, a top first side flap attached to a top edge of the first side, a top second side flap attached to a top edge of the second side;

wherein the bottom face comprises a bottom back flap attached to a bottom edge of the back face, a bottom front flap attached to a bottom edge of the front face, a bottom first side flap attached to a bottom edge of the first side, a bottom second side flap attached to a bottom edge of the second side;

wherein the front face is foldably connected to a front edge of the second side face such that the front face can rotate about an axis defined by the front edge of the second face when the fastener assembly is not engaged to allow access to the interior cavity; and wherein the perforation defines an opening flap with an area covering at least a portion of the back face.

2. The packaging carton of claim 1, the opening flap further comprising:

a tab comprising at least one folding edge and at least one perforation edge;

wherein the at least one perforation edge forms at least a portion of the perforation defining the opening flap; and wherein the at least one folding edge disposes the tab to be folded into the interior storage cavity when the tab and at least the back face are separated along the at least one perforation edge.

3. The packaging carton of claim 1, wherein the opening flap's shape is parabolic.

4. The packaging carton of claim 1, wherein the top face, back face, and top edge of the front face comprise the perforation defining the opening flap, and wherein the opening flap may be permanently removed by separating the opening flap from the top face and back face along the perforation to define an access opening in the top face and back face that allows access to the interior storage cavity.

5. The packaging carton of claim 1, wherein:

the top face is a single panel;

the second side face comprises a second side front flap attached to the second side edge of the front face, a second side back flap attached to the second side edge of the back face, a second side top flap connected to a second side edge of the top face, a second side bottom flap connected to a second side edge of the bottom face, wherein the second side face flaps are attached together by an adhesive; and wherein a back bottom flap attached to the back edge of the bottom face is attached to the back face by an adhesive.

6. The method of making a packaging carton for a food product comprising:

providing a blank;

assembling the blank into a carton with a front face, a back face, a first side face connecting a first side edge of the front face and a first side edge of the back face, a second side face connecting a second side edge of the front face and a second side edge of the back face, a top face connected to a top edge of the front face, back face, first side face and second side face, and a bottom face connected to a bottom edge of the front face, back face, first side face and second side face, wherein the front, back, first side, second side, top and bottom faces define an interior storage cavity; and defining an opening flap on at least the back face by perforating the material of at least the back face so that the opening flap may be permanently removed by separating the opening flap and at least the back face along the perforation to define an access opening in at least the back face that allows access to the interior storage cavity;

further wherein:

the front face is a single panel;

the back face is a single panel;

the first side face comprises a first side front flap attached to the first side edge of the front face, a first side back flap attached to the first side edge of the back face, and a fastener assembly, wherein the fastener assembly selectively allows the first side front and first side back flap to securely engage each other or disengage each other;

the second side face is a single panel;

the perforation defines an opening flap with an area covering at least a portion of the back face; and the front face is foldably connected to a front edge of the second side face such that the front face can rotate about an axis defined by the front edge of the second face when the fastener assembly is not engaged to allow access to the interior cavity; and the method further comprising:

folding the blank along the first side edge of the back face, second side edge of the back face, and second side edge of the front face to define the interior cavity;

connecting a top back flap attached to a top edge of the back face, a top first side flap attached to a top edge of the first side, and a top second side flap attached to a top edge of the second side to comprise the top face; and connecting a bottom back flap attached to a bottom edge of the back face, a bottom first side flap attached to a bottom edge of the first side and a bottom second side flap attached to a bottom edge of the second side to comprise the bottom face.

7. The method of claim 6 further comprising:

defining a tab comprising with least one folding edge and at least one perforation edge, wherein the at least one perforation edge forms at least a portion of the perforation defining the opening flap and wherein the at least one folding edge disposes the tab to be folded into the interior storage cavity when the tab and at least the back face are separated along the at least one perforation edge.

8. The method of claim 6, wherein the opening flap's shape is parabolic.

9. The method of claim 6, wherein the perforation is made by laser or blade scoring.

10. The method of claim 6, further comprising defining the opening flap such that the perforation covers some or all of the top face, back face, and top edge of the front face, and wherein the opening flap may be permanently removed by separating the opening flap from the top face and back face along the perforation to define an access opening in the top face and back face that allows access to the interior storage cavity.

11. The method of claim 6, wherein:

the top face is a single panel;

the second side face comprises a second side front flap attached to the second side edge of the front face, a second side back flap attached to the second side edge of the back face, a second side top flap connected to a second side edge of the top face, a second side bottom flap connected to a second side edge of the bottom face;

the bottom face comprises a bottom flap; and the method further comprising:

folding the blank along the top and bottom edges of the front face and back face to define the interior cavity;

attaching the second side flaps together by an adhesive; and attaching the bottom flap to the back face by an adhesive.

12. The method of claim 11, further comprising:

loading at least one food product into the interior cavity; and fastening the fastener assembly of the first side face.

13. The method of claim 6, further comprising:

loading at least one food product into the interior cavity;

folding the front face about the axis defined by the front edge of the second face enclose the interior cavity; and fastening the fastener assembly of the first side face.

14. The method of claim 6, wherein the packaging carton is shaped and sized to provide an upright storage carton.

15. The method of claim 6, wherein the blank is assembled on a high speed cartoning line.

16. The method of claim 15, further comprising loading at least one food item into the packaging carton on the high speed cartoning line.

* * * * *